United States Patent [19]

Velencei

[11] Patent Number: 4,683,845

[45] Date of Patent: Aug. 4, 1987

[54] TWO-PISTON INTERNAL COMBUSTION ENGINE (JV-2)

[76] Inventor: John Velencei, Daly Rd., Far Hills, N.J. 07931

[21] Appl. No.: 674,944

[22] Filed: Nov. 26, 1984

[51] Int. Cl.[4] ..... F02B 33/24

[52] U.S. Cl. ..... 123/73 PP; 123/72 A; 123/65 R

[58] Field of Search ..... 123/65 R, 65 VC, 65 V, 123/73 R, 73 A, 51 R, 51 B, 51 BC, 51 BA, 51 BD, 188 B

[56] References Cited

U.S. PATENT DOCUMENTS

| | | | |
|---|---|---|---|
| 1,292,322 | 1/1919 | Hunt | 123/73 PP |
| 1,540,286 | 6/1925 | Roberts | 123/73 PP |
| 2,316,790 | 4/1943 | Hickey | 123/65 VC |
| 2,337,245 | 12/1943 | Jacklin | 123/73 PP |
| 2,516,708 | 7/1950 | Lugt | 123/73 PP |
| 2,572,768 | 10/1951 | Schneeberger | 123/73 PP |
| 3,921,297 | 7/1976 | Fox | 123/73 PP |
| 4,004,557 | 1/1977 | Acker | 123/73 PP |
| 4,066,050 | 1/1978 | Ford-Dunn | 123/73 PP |
| 4,359,017 | 11/1982 | May | 123/73 R |

FOREIGN PATENT DOCUMENTS

| | | | |
|---|---|---|---|
| 0159918 | 10/1982 | Japan | 123/73 A |
| 362453 | 12/1931 | United Kingdom | 123/65 W |

*Primary Examiner*—Carl Stuart Miller
*Attorney, Agent, or Firm*—Jack B. Murray, Jr.

[57] ABSTRACT

An internal combustion engine cylinder assembly comprising a first elongated cylinder having substantially vertically disposed interior walls defining an elongated firing chamber therein; first piston means housed within the firing chamber and adapted for vertical reciprocation within the firing chamber; gas inlet channels means in the lower portion of the firing chamber; a crankcase housing having a gas compression chamber disposed therein; valve means adapted to permit fresh fuel/air mixtures to be charged into the gas compression chamber upon the depressuring of the chamber; second cylinder means positioned at the upper end of the first cylinder and having an exhaust chamber therein and a second piston means disposed within the exhaust chamber and adapted for vertical reciprocation therein, the exhaust chamber communicating with the upper end of the firing chamber; the second cylinder means being provided in the lower portion thereof with at least one exhaust gas port adapted for cyclic opening and closing to permit removal of exhaust gases from the firing chamber; at least a portion of the first elongated cylinder extending downwardly into the gas compression chamber and being adapted to house at least a portion of the first piston means during the full downstroke of the first piston means; the upper portion of the crankcase having inwardly sloping walls to define a converging gas space in the upper portion of the gas compression chamber annularly about the downwardly extending first cylinder portion.

11 Claims, 3 Drawing Figures

TWO-PISTON INTERNAL COMBUSTION ENGINE (JV-2)

CROSS REFERENCE TO RELATED APPLICATION

This application is related to applicant's co-pending application Ser. No. 061,674,945, filed Oct. 26, 1984, entitled "Improved Internal Combustion Engine".

BACKGROUND OF THE INVENTION

1. Field of the Invention

This invention relates generally to the field of internal combustion engines, and more particularly to two-stroke internal combustion engines.

2. Description of the Prior Art

U.S. Pat. No. 1,292,322 is directed to a water cooled two cycle gas engine provided with a dual walled cylinder having a lower, rotatably mounted perforated valve member for gas entry and accuated by a first cam and spring/rocker arm arrangement. Gases exhaust through an upper reciprocating sleeve valve member controlled by a cam movably connected to the shaft to the cylinder's piston connecting rod is also connected.

U.S. Pat. No. 1,540,286 relates to an internal combustion piston engine provided with exhaust valves located in the upper portion of the cylinder. The engine is also provided with either a rotary gas inlet or a crankcase gas inlet valve communicating with a crankcase gas pressuring chamber.

U.S. Pat. No. 2,337,245 discloses an internal combustion engine of the two stroke type having a set of gas inlet ports at one end of the cylinder and a set of gas exhaust ports at the other cylinder end. Each set of gas ports is opened and closed by means of a separate reciprocating piston which is positioned in the cylinder.

U.S. Pat. No. 2,516,708 relates to a single-acting two-stroke cyclic internal cobustion engine having an associated air scavenging chamber adjacent to the gas inlet end of the cylinder.

U.S. Pat. No. 2,572,768 also relates to a two-stroke internal combustion engine having gas inlet ports providing swirling motion by tangential gas injection arrangements.

U.S. Pat. No. 4,004,557 discloses a piston-cylinder assembly having a cup-like upper extension of the piston, and a plurality of vertical passages between the crankcase and the cylinder.

SUMMARY OF THE INVENTION

An internal combustion engine cylinder assembly comprising a first elongated cylinder having substantially vertically disposed interior walls defining an elongated firing chamber therein; first piston means housed within the firing chamber and adapted for vertical reciprocation within the firing chamber; gas inlet channels means in the lower portion of the firing chamber; a crankcase housing having a gas compression chamber disposed therein; valve means adapted to permit fresh fuel/air mixtures to be charged into the gas compression chamber upon the depressuring of the chamber; second cylinder means positioned at the upper end of the first cylinder and having an exhaust chamber therein and a second piston means disposed within the exhaust chamber and adapted for vertical reciprocation therein, the exhaust chamber communicating with the upper end of the firing chamber; the second cylinder means being provided in the lower portion thereof with at least one exhaust gas port adapted for cyclic opening and closing to permit removal of exhaust gases from the firing chamber; at least a portion of the first elongated cylinder extending downwardly into the gas compression chamber and being adapted to house at least a portion of the first piston means during the full downstroke of the first piston means; the upper portion of the crankcase having inwardly sloping walls to define a converging gas space in the upper portion of the gas compression chamber annularly about the downwardly extending first cylinder portion, the gas inlet channels providing gaseous communication between the firing chamber and the converging gas space; the first piston means being arranged to cyclically open and close the gas inlet channels to permit the gaseous communication with the converging gas space; the second piston means being adapted to cyclically open and close the gas exhaust ports to control the removal of exhaust gases from the firing chamber; the first piston means cooperating with the second piston means and the fuel ignition means for controlling the compression and charging of fresh fuel/air mixtures into the firing chamber from the gas compression chamber and the pressurization thereof in the firing chamber for ignition to generate power and to remove from the firing chamber the thus formed exhaust gases.

DETAILED DESCRIPTION OF THE INVENTION

Figure 1:
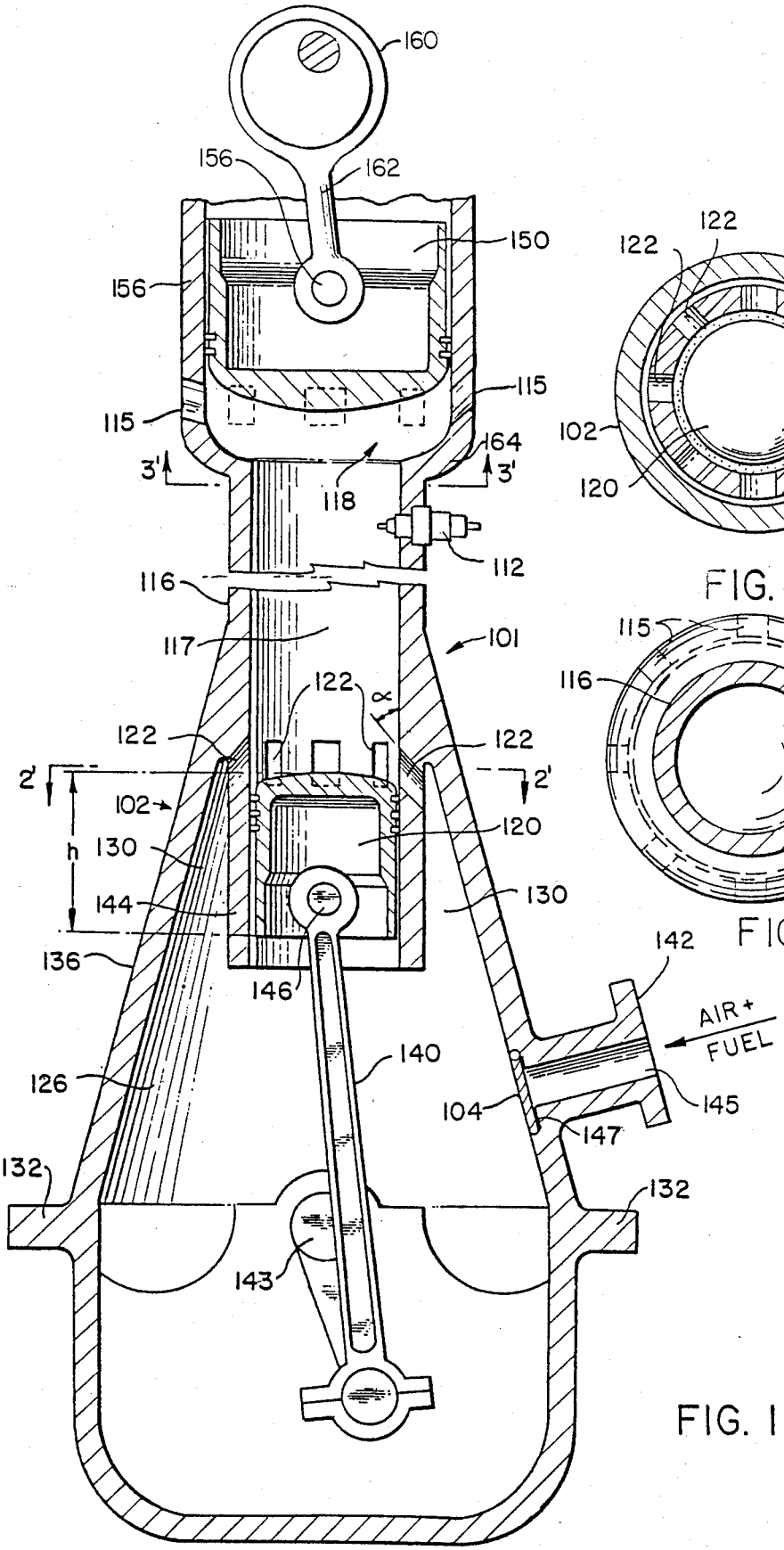
FIG. 1 is a vertical cross-sectional view of one embodiment of this invention's internal combustion engine, with a single cylinder thereof being illustrated.
Figure 2:
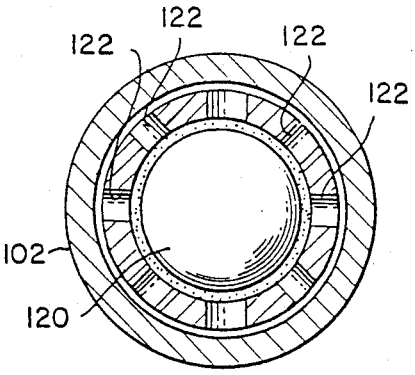
FIG. 2 is an enlarged horizontal cross-sectional view of the cylinder of FIG. 1 taken along line 2'—2' in FIG. 1.
Figure 3:
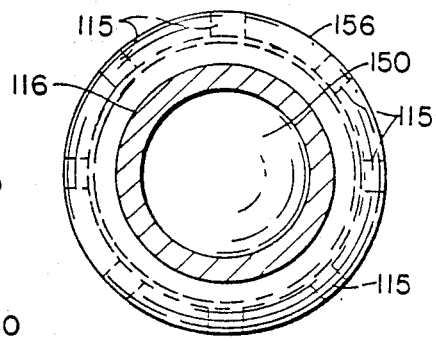
FIG. 3 is an enlarged horizontal cross-sectional view of the cylinder of FIG. 1 taken along line 3'—3' in FIG. 1.

Referring to FIGS. 1 and 2, a single cylinder of an engine of this invention is illustrated. It will be understood that engines of this invention can comprise a single such cylinder or a multiple of such cylinders, all the cylinders of said engine being the same in principle and mechanism, the particular engine shown being of especially light construction and designed for use in motorcycles, boats, electrical generators and the like.

As illustrated, the engine is air cooled, as is preferred, although it will be understood that water or oil cooling can be used if desired, by provision of a suitable jacket about at least a portion of cylinder 116 to contain the selected cooling fluid and to maintain the cooling fluid in wall cooling relationship with the outer walls of cylinder 116.

As illustrated, my engine, indicated generally at 101, comprises a crankcase housing 102 which is provided with a suitable engine mounting means 132 and which is associated with a crankshaft 143 and a connecting piston rod 140, which is in turn rotatably connected to a piston 120 by means of a first wrist pin 146.

A gas compression chamber 126 is provided within the upper portion 136 of crankcase housing 102 which is in cyclic gas communication with gas inlet 145. Inlet 145 is opened and closed by means of reed valve 104 positioned in a recessed portion 147 of the inner walls of crankcase housing 102. Reed valve 104 is pivoted at 135 for pivotal motion inwardly into chamber 126 to permit gas flow thereinto from gas passage 145 when the gas pressure in chamber 126 is less than the pressure in passage 145. Reed valve 104 is prevented from pivoting into passage 145 upon pressuring of chamber 126 by suitably sizing recessed portion 147 to securely seat valve 104 therein when valve 104 is in the closed position (as shown in FIG. 1) and the fit of valve 104 within recessed portion 147 should be such as to substantially prevent the backflow of gases from gas chamber 126 into passage 145 when chamber 126 is pressured, as will be described in more detail below. Reed valve 104 can also be constructed as any other elongated unit any valve member known in the art which is positioned as shown in FIG. 1 for bending motion inwardly into gas chamber 126.

Cylinder 116 comprises an elongated, hollow, substantially cylindrical member adapted to house therein an elongated firing chamber 117 and first piston 120 in the lower portion of chamber 117 so as to permit piston 120 to vertically reciprocate in firing chamber 117.

At least a portion of the cylinder, indicated at 144, projects downwardly into gas chamber 126, to house at least a portion of piston 120 at its lowest (downstroke) point. Preferably, the length of wall portion 144 thus positioned will range from about 0.1 to 2 times the height "h" of piston 120, and more preferably from about 0.4 to 1.5 times such height "h". However, such dimensions are only preferred and other lengths of wall portion 144 can also be used.

Cylinder 116 is securely affixed to crankcase housing 102 and, as is illustrated in FIG. 1, cylinder 116 and crankcase housing 102 can be formed as a unitary structure.

A plurality of spaced apart gas channels 122 are provided in the lower portion of the walls of cylinder 116 adjacent to walls 144 to permit gaseous communication between gas compression chamber 126 and firing chamber 117. The manner in which such gas channels 122 are opened and closed will be described below. The number and precise positioning of such channels 122 about the periphery of cylinder 116 can vary, but preferably channels 122 are spaced apart evenly about the circumference of the cylinder wall portion 144 as shown in FIG. 2. The number and size of such channels 122 is preferably selected as that which provides the maximum air flow, hence the greatest cross sectional area, consistent with the need to maintain the structural integrity of walls 116 and 144. Generally from about 2 to 20 such channels will be employed, with from about 6 to 10 being preferred. Where a plurality of such channels 122 are used, each such channel 122 will preferably have a horizontal cross sectional area (as shown in FIG. 2) which is from about 1 to 10 percent, and more preferably from about 3 to 8 percent, of the total cross sectional area of the annulus (defined in such view, inclusive of all such channels 122) of cylinder wall 116. Also, the total area of such channels 122 will generally range from about 10 to 60 percent or more, and preferably from about 25 to 45 percent, of the total cross sectional area of such cylinder wall annulus.

At the upper end of crankcase housing 102, in accordance with the illustrated embodiment of my invention, the walls of housing 102 are inwardly sloping to define upper converging gas spaces 130 within gas chamber 126 which gas spaces are positioned about lower cylinder wall 144. Each gas channel 122 communicates with the uppermost part of converging gas space 130, to permit the rapid and efficient gas charging of chamber 117. Each such gas channel 122 is preferably substantially circular in cross section (in the direction of gas flow therethrough) and is preferably angularly disposed such that the center longitudinal axis of each channel 122 forms an angle "$\alpha$" with the vertical, inner wall of chamber 117, of from about 10 to 60 degrees, most preferably from about 30 to 50 degrees. The combination of such converging gas space 130 and angulary disposed gas channels 122 has been found to provide gas charging with high velocities and efficiencies.

At the upper end of cylinder 116 is provided at least one spark plug 112 (or other fuel ignition means) to permit the air/fuel mixture in chamber 117 to be ignited. Also at the uppermost end of cylinder 116 there is provided an exhaust piston means comprising an expanded cylinder 156 housing piston 150, cam means 160 and exhaust ports 115. One or more exhaust ports 115 are located at the lower portion of expanded cylinder 156 and permit gaseous communication between this uppermost end of firing chamber 117 and an exhaust manifold (not shown) or other conventional exhaust disposal means to permit the collection and withdrawal of exhaust gases from cylinders 116 and 156.

Piston 150 is adapted to reciprocate vertically within an elongated chamber 118 defined within expanded cylinder section 156. Such motion of piston 150 is controlled by cam means 160 which comprises a cam and connecting rod 162 to which piston 150 is rotatably connected by means of second wrist pin 163. The length of the stroke of piston 150 is sufficient to open and close exhaust ports 115.

The number, size and precise positioning of the exhaust ports 115, similarly to the gas inlet channels 122, can vary, and thus from about 1 to 20 such exhaust ports 115 of substantially cylindrical cross section will be generally employed, each such port having a cross sectional area of from about 1 to 10 percent of the total cross sectional area of the cylinder walls 156 (inclusive of such ports 115) taken transversely to the longitudinal axis of cylinder 156, and the total cross sectional area of such ports 115 being from about 10 to 60 percent or more of the total cross sectinal area of such an annulus of cylinder 156.

Upper expanded cylinder 156 defines an expanded cylindrical elongated chamber 118 therein having a diameter which is greater (preferably from about 10 to 150 percent, and more preferably from about 30 to 80 percent greater) than the diameter of firing chamber 117. Such an arrangement of exhaust ports 115 and enlarged second upper piston 150 permits the greatly improved efficiencies in gas exhaust removal from firing chamber 117, and therefore permits the engine of this invention to be operated at high revolutions per minute (that is, at high rates of piston cyclic reciprocations) with smooth, turbulent reduced operation.

The length of firing chamber 117 and the positioning of spark plug 112 is such that at the full upper stroke of first piston 120 (such position not being shown in the drawings), piston 120 will not come into contact with spark plug 112 or with any portion of the expanded cylinder 156 and its associated piston 150. At its full lower stroke piston 120 uncovers gas inlet channels 122 to permit gaseous communication between gas compression chamber 126 and firing chamber 117. In turn lower portion 144 of cylinder 116 is of a sufficient length to ensure that piston 120, at its lowest point, remains substantially fully housed within the cylindrical extension of chamber 117 formed by the inner walls of cylinder portion 144.

Referring to upper piston 150, in its full upper stroke, the exhaust ports 115 are uncovered to allow the outward flow of gases from firing chamber 117. At its lowest point, which occurs at its full downward stroke, piston 150 fully covers exhaust ports 115 to prevent the flow of gases therethrough either into or out of the firing chamber 117 during compression and ignition of the fuel/air mixture therein, as will be described in more detail below.

In the usual two-stroke operation, air and fuel (which can be premixed in the proper or desired ratio by conventional means, such as a carbeurator means, fuel injection or turbocharging) are drawn into gas compression chamber 126 by means of valve 104 when piston 120 moves in its upstroke after the closing of channels 122, thereby depressuring chamber 126 sufficiently to permit fresh gases to pass thereto from passage 145. In its downstroke, piston 120 pressurizes the gases trapped in chamber 126 upon closing of valve 104. Upon reaching a lower point in its downstroke, the upper surface of piston 120 uncovers, and thus opens, gas channels 122 and permits the pressurized gases to pass from converging gas space 130 through channels 122 into firing chamber 117, in which the pressure had been previously lowered as a result of the piston 120 downstroke and the opening of exhaust ports 115 by means of the upstroke of upper piston 150. Exhaust ports 115 are caused by the downstroke of upper piston 150 to close after the fresh fuel/air mixture is introduced into chamber 117 to permit the fresh gases to be pressured during the upstroke of piston 120. If desired, the timing of the downstroke of upper piston 150 can be adjusted such that exhaust ports 115 remain open for a portion of the upstroke of lower piston 120 to permit the lowermost gas layer (which comprises the fresh fuel/air mixture) to assist in more completely forcing the exhaust gases from chamber 117. At the desired point in the upward travel of lower piston 120, when gas exhaust ports 115 are closed, spark plug 112 is activated to cause the thus pressured fuel/air mixture to explosively ignite and to thereby force piston 120 downwardly, whereupon exhaust ports 115 are opened by the upward motion of the upper piston 150 to allow the thus-formed exhaust gases to exit chamber 117. The timing and precise manner of operation of pistons 150 and 120 and their associated cam means, and spark plug 112 is fully conventional, and since such will be readily understood by one of ordinary skill in the art having reference to the instant description, further detailed explanation or description thereof will not be given herein.

It is to be understood that the form of my invention herein shown and described is to be taken as a preferred example of the same and that various changes in the shape, size, and arrangement of parts may be resorted to without departing from the spirit of my invention, or the scope of the claims hereinafter presented.

I claim:

1. An internal combustion engine cylinder assembly comprising a first elongated cylinder having substantially verticlaly disposed interior walls defining an elongated firing chamber therein; first piston means housed within said firing chamber and adapted for vertical reciprocation within said firing chamber; gas inlet channels means in the lower portion of said firing chamber; a crankcase housing having a gas compression chamber disposed therein; valve means adapted to permit fresh fuel/air mixtures to be charged into said gas compression chamber upon the depressuring of said chamber; second cylinder means positioned at the upper end of said first cylinder and having an exhaust chamber therein and a second piston means disposed within said exhaust chamber and adapted for vertical reciprocation therein, said exhaust chamber communicating with the upper end of said firing chamber; said second cylinder means being provided in the lower portion thereof with at least one exhaust gas port adapted for cyclic opening and closing to permit removal of exhaust gases from said firing chamber; at least a portion of said first elongated cylinder extending downwardly into said gas compression chamber and being adapted to house at least a portion of said first piston means during the full downstroke of said first piston means; the upper portion of said crankcase having inwardly sloping walls to define a substantially uniformly converging gas space in the upper portion of said gas compression chamber annularly about said downwardly extending first cylinder portion, said gas inlet channels providing direct gaseous communication between said firing chamber and said converging gas space; said first piston means being arranged to cyclically open and close said gas inlet channels to permit said gaseous communication with said converging gas space; said second piston means being adapted to cyclically open and close said gas exhaust ports to control the removal of exhaust gases from said firing chamber; said first piston means cooperating with said second piston means and said fuel ignition means for controlling the compression and charging of fresh fuel/air mixtures into said firing chamber from said gas compression chamber and the pressurization thereof in said firing chamber for ignition to generate power and to remove from said firing chamber the thus formed exhaust gases.

2. The internal combustion engine cylinder assembly of claim 1 wherein said second cylinder means is adapted to provide an exhaust chamber therein having a diameter which is greater than the diameter of said firing chamber.

3. The internal combustion engine cylinder assembly according to claim 1 wherein said downwardly extending portion of said first elongated cylinder has a length of from about 0.4 to 1.5 times the height of said first piston means.

4. The internal combustion engine cylinder assembly according to claim 1 wherein said gas inlet channels are spaced apart evenly about the circumference of said firing chamber's lower portion.

5. The internal combustion engine cylinder assembly according to claim 4 wherein a total of from about 6 to 10 of said gas inlet channels are provided about said lower circumference in said firing chamber.

6. The internal combustion engine cylinder assembly according to claim 1 wherein each said gas inlet channel is disposed such that its center longitudinal axis forms an angle of from about 10 to 60 degrees with said vertically disposed interior walls of said elongated firing chamber.

7. An internal combustion engine cylinder assembly comprising a first elongated cylinder having substantially vertically disposed interior walls defining an elongated firing chamber therein; first piston means housed within said firing chamber and adapted for vertical reciprocation within said firing chamber; upwardly sloping gas inlet channel means in the lower portion of said firing chamber, the center longitudinal axis of each said gas inlet channel forming an angle of from about 10 to 60 degrees with said vertically disposed interior walls; a crankcase housing having a gas compression chamber disposed therein; valve means adapted to permit fresh fuel/air mixtures to be charged into said gas compression chamber upon the depressuring of said chamber; second cylinder means positioned at the upper end of said first cylinder and having an exhaust chamber therein and a second piston means disposed within said exhaust chamber and adapted for vertical reciprocation therein, said exhaust chamber communicating with the upper end of said firing chamber; said second cylinder means being provided in the lower portion thereof with at least one exhaust gas port adapted for cyclic opening and closing to permit removal of exhaust gases from said firing chamber; at least a portion of said first elongated cylinder extending downwardly into said gas compression chamber and being adapted to house at least a portion of said first piston means during the full downstroke of said first piston means; the upper portion of said crankcase having inwardly sloping walls to define a converging gas space in the upper portion of said gas compression chamber annularly about said downwardly extending first cylinder portion, said gas inlet channels providing direct gaseous communication between said firing chamber and said converging gas space; said first piston means being arranged to cyclically open and close said gas inlet channels to permit said gaseous communication with said converging gas space; said second piston means being adapted to cyclically open and close said gas exhaust ports to control the removal of exhaust gases from said firing chamber; said first piston means cooperating with said second piston means and said fuel ignition means for controlling the compression and charging of fresh fuel/air mixtures into said firing chamber from said gas compression chamber and the pressurization thereof in said firing chamber for ignition to generate power and to remove from said firing chamber the thus formed exhaust gases.

8. The internal combustion engine cylinder assembly of claim 7 wherein said second cylinder means is adapted to provide an exhaust chamber therein having a diameter which is greater than the diameter of said firing chamber.

9. The internal combustion engine cylinder assembly according to claim 7 wherein a total of from about 2 to 20 of said gas inlet channels are provided in said firing chamber's lower portion.

10. The internal combustion engine cylinder assembly according to claim 9 wherein said gas inlet channels are spaced substantially evenly apart about said firing chamber's lower portion.

11. The internal combustion engine cylinder assembly according to claim 10 wherein said downwardly extending portion of said elongated cylinder walls have a length of from about 0.4 to 1.5 times the height of said first piston means.

* * * * *